US010195640B2

(12) United States Patent
Svec

(10) Patent No.: US 10,195,640 B2
(45) Date of Patent: Feb. 5, 2019

(54) METHOD AND APPARATUS FOR COATING A MOVING SUBSTRATE

(71) Applicant: Building Materials Investment Corporation, Dallas, TX (US)

(72) Inventor: James A. Svec, Kearny, NJ (US)

(73) Assignee: Building Materials Investment Corporation, Dallas, TX (US)

( * ) Notice: Subject to any disclaimer, the term of this patent is extended or adjusted under 35 U.S.C. 154(b) by 230 days.

(21) Appl. No.: 15/196,468

(22) Filed: Jun. 29, 2016

(65) Prior Publication Data

US 2016/0375463 A1 Dec. 29, 2016

Related U.S. Application Data

(60) Provisional application No. 62/186,136, filed on Jun. 29, 2015.

(51) Int. Cl.

| | |
|---|---|
| ***B05C 9/04*** | (2006.01) |
| ***B05C 5/02*** | (2006.01) |
| ***B05D 1/02*** | (2006.01) |
| ***B05C 13/00*** | (2006.01) |
| ***E04D 1/12*** | (2006.01) |
| ***B05C 9/06*** | (2006.01) |
| *E04D 1/00* | (2006.01) |
| *E04D 1/20* | (2006.01) |
| *B05C 5/00* | (2006.01) |

(52) U.S. Cl.

CPC ..... *B05D 1/02* (2013.01); *B05C 5/0254* (2013.01); *B05C 9/04* (2013.01); *B05C 9/06* (2013.01); *B05C 13/00* (2013.01); *E04D 1/12* (2013.01); *B05C 5/001* (2013.01); *B05C 5/0245* (2013.01); *E04D 1/20* (2013.01); *E04D 2001/005* (2013.01)

(58) Field of Classification Search

USPC ..... 118/316, 325, 315–315, 411, 412

See application file for complete search history.

(56) References Cited

U.S. PATENT DOCUMENTS

| | | | | |
|---|---|---|---|---|
| 5,650,011 | A * | 7/1997 | Yoshinaga | B05C 5/0254 118/316 |
| 5,902,683 | A | 5/1999 | Sieloff | |
| 6,228,785 | B1 | 5/2001 | Miller et al. | |
| 6,341,462 | B2 | 1/2002 | Kiik et al. | |
| 6,455,105 | B1 * | 9/2002 | Sakai | B05C 5/0258 118/410 |

(Continued)

*Primary Examiner* — Yewebdar T Tadesse

(74) *Attorney, Agent, or Firm* — Womble Bond Dickinson (US) LLP

(57) ABSTRACT

A method for applying coating material to a moving substrate such as a glass mat web in shingle manufacturing includes conveying the web through a narrow channel and ejecting at least one coating material onto at least one surface of the web as it is conveyed through the channel. In a preferred embodiment, multiple coating materials may be applied to one surface of the web and multiple coating materials may be applied to the other surface of the web. The coating materials may be molten asphalt or other coating materials. The pressure of the coating material is controlled as a function of the line speed of the moving substrate to ensure consistently thick coatings at various speeds, including relatively high speeds, of the web. An apparatus in the form of a slot die is disclosed for carrying out the method of the invention.

1 Claim, 4 Drawing Sheets

(56) References Cited

U.S. PATENT DOCUMENTS

| | | | |
|---|---|---|---|
| 6,546,688 | B1 | 4/2003 | Parsons |
| 6,564,682 | B1 | 5/2003 | Zurecki et al. |
| 6,709,994 | B2 | 3/2004 | Miller et al. |
| 6,808,785 | B1 | 10/2004 | Friedman et al. |
| 6,864,195 | B2 | 3/2005 | Peng |
| 7,048,990 | B2 | 5/2006 | Koschitzky |
| 7,070,843 | B2 | 7/2006 | Bartek et al. |
| 7,070,844 | B2 | 7/2006 | Bartek |
| 7,140,153 | B1 | 11/2006 | Humphreys et al. |
| 7,442,270 | B2 | 10/2008 | Bartek |
| 7,442,658 | B2 | 10/2008 | Rodrigues et al. |
| 7,670,668 | B2 | 3/2010 | Greaves et al. |
| 7,851,051 | B2 | 12/2010 | DeJarnette et al. |
| 8,226,790 | B2 | 7/2012 | Rodriques et al. |
| 8,266,861 | B2 | 9/2012 | Koch et al. |
| 8,277,881 | B2 | 10/2012 | Khan et al. |
| 8,309,169 | B2 | 11/2012 | Teng et al. |
| 8,333,040 | B2 | 12/2012 | Shiao et al. |
| 8,389,103 | B2 | 3/2013 | Kiik et al. |
| 8,557,366 | B2 | 10/2013 | Harrington, Jr. et al. |
| 8,826,607 | B2 | 9/2014 | Shiao et al. |
| 2003/0188503 | A1 | 10/2003 | Parsons |
| 2004/0014385 | A1 | 1/2004 | Greaves, Jr. et al. |
| 2004/0081789 | A1 | 4/2004 | Kim |
| 2005/0210808 | A1 | 9/2005 | Larson et al. |
| 2006/0060135 | A1* | 3/2006 | Rankin, Jr. ..... B05C 5/025 118/412 |
| 2009/0260309 | A1 | 10/2009 | Humphreys et al. |
| 2010/0005745 | A1 | 1/2010 | Harrington, Jr. |
| 2010/0212235 | A1 | 8/2010 | Barrego |
| 2011/0017278 | A1 | 1/2011 | Kalkanoglu et al. |
| 2011/0104461 | A1 | 5/2011 | Grubka |
| 2011/0232220 | A1 | 9/2011 | Belt et al. |
| 2014/0259820 | A1 | 9/2014 | Humphreys et al. |

* cited by examiner

METHOD AND APPARATUS FOR COATING A MOVING SUBSTRATE

REFERENCE TO RELATED APPLICATION

Priority is hereby claimed to the filing date of U.S. provisional patent application 62/186,136 filed on Jun. 29, 2015, the contents of which are hereby incorporated by reference.

TECHNICAL FIELD

This invention relates generally to coating moving substrates with a coating material, and more specifically to applying saturation coatings of asphalt and top and bottom coatings of asphalt to a moving glass mat substrate in the manufacturing of asphalt roofing shingles.

BACKGROUND

In traditional shingle manufacturing, a glass mat web or other substrate is moved in a downstream direction past various stations of a manufacturing line. At one station, the glass mat is saturated with molten liquid asphalt to form a moisture barrier. The saturated substrate is then coated with top and/or bottom coats of asphalt prior to application of protective granules and cutting to form individual shingles. Multiple shingles may be cut across the width of the web. Prior art coating processes in shingle manufacturing typically utilize a roll coating technique, wherein a coating material such as molten asphalt is pumped into a puddle in front of a coating roller. The substrate is conveyed through the coating puddle into a nip roll, which meters the amount of coating applied to the substrate. The roll holds back excess coating material, which pours into a pan and back to a surge tank to be recirculated back to the puddle.

The above technique has been used for many years and works well at line speeds, i.e. the speed of the moving web in the downstream direction, up to about 850 feet per minute. However, the technique exhibits inherent limitations at line speeds higher than this, making it unsuitable for high speed shingle manufacturing above 850, and more specifically above 1000, feet per minute. The coating step in shingle manufacturing has thus become a limiting link in the chain when attempting to increase line speeds in shingle manufacturing plants above traditional speeds. Further, so much molten asphalt in the traditional puddle and roller technique generates fumes and smoke that can become a health hazard for plant workers.

A need exists for a method and apparatus for saturating and coating a moving web of substrate material in shingle manufacturing at line speeds of 1000 feet per minute and higher while maintaining a desired and consistent thickness and saturation of the coating material. A further need exists for a method and apparatus that enables application of multiple layers coating materials and different coating materials and profiles on the top and bottom of the web. It is to such a method and apparatus that the present invention is primarily directed.

SUMMARY

Briefly described, a multi-coat pultrusion die is formed with an upper portion and a lower portion. The die preferably is long enough to span the width of a glass mat (or other substrate such as organic felt) to be coated. A relatively narrow long central channel is defined between the upper portion and the lower portions of the die. The substrate to be coated is conveyed through the narrow channel as it moves in the downstream direction. The upper and lower portions of the die each includes a first inlet for receiving a first coating material under pressure and may include a second inlet for receiving a second coating material under pressure. The first inlets communicate through flow channels with respective first slit nozzles extending along and opposing one another on either side of the central channel. The second inlets, if present, communicate through flow channels with respective second slit nozzles extending along and opposing one another on either side of the central channel. The second slit nozzles are located downstream of the first slit nozzles with respect to the direction of movement of the substrate. The first and second inlets are coupled to respective sources of coating material such as molten asphalt under high but controllable pressure.

As a glass mat or other substrate is conveyed through the central channel of the die, coating materials are ejected in the form of a fan or curtain through the slit nozzles onto the moving substrate. The pressures at which the coating materials are delivered to the die are controlled as a function of, for example, line speed, viscosity of the material, and desired coating thickness. In this way, coatings of a desired thickness can be applied to the substrate accurately and consistently regardless of the line speed or real time changes in line speed of the substrate through the central channel. Further, unlike prior art coating techniques, different coating materials or no coating material at all can be supplied to one or more of the inlets of the die as desired to create custom layered coating profiles in a single operation. Custom coating profiles simply are not possible with prior art puddle and roller coating techniques.

Also, since the molten asphalt (or other coating material) is largely contained and not exposed to the atmosphere during the coating process, the volume of asphalt fumes and smoke released into the plant is greatly reduced. This lowers health risks to workers in the plant and renders the work atmosphere more pleasant.

Accordingly, a method and apparatus for coating a moving substrate in shingle manufacturing is provided that addresses problems and shortcomings of prior art coating techniques and that provides new functionality not possible with such prior art techniques. Toxic fumes and smoke are greatly reduced because molten asphalt is largely contained during the coating process. The method and apparatus can function reliably to maintain coating thickness within tight tolerances at line speeds far higher than are possible with traditional puddle and roller techniques. The coating process thus ceases to be a bottleneck to increasing the speed of production. These and other aspects, features, and advantages of the invention disclosed herein will be understood better upon review of the detailed description set forth below taken in conjunction with the accompanying drawing figures, which are briefly described as follows.

DETAILED DESCRIPTION

Figure 1:
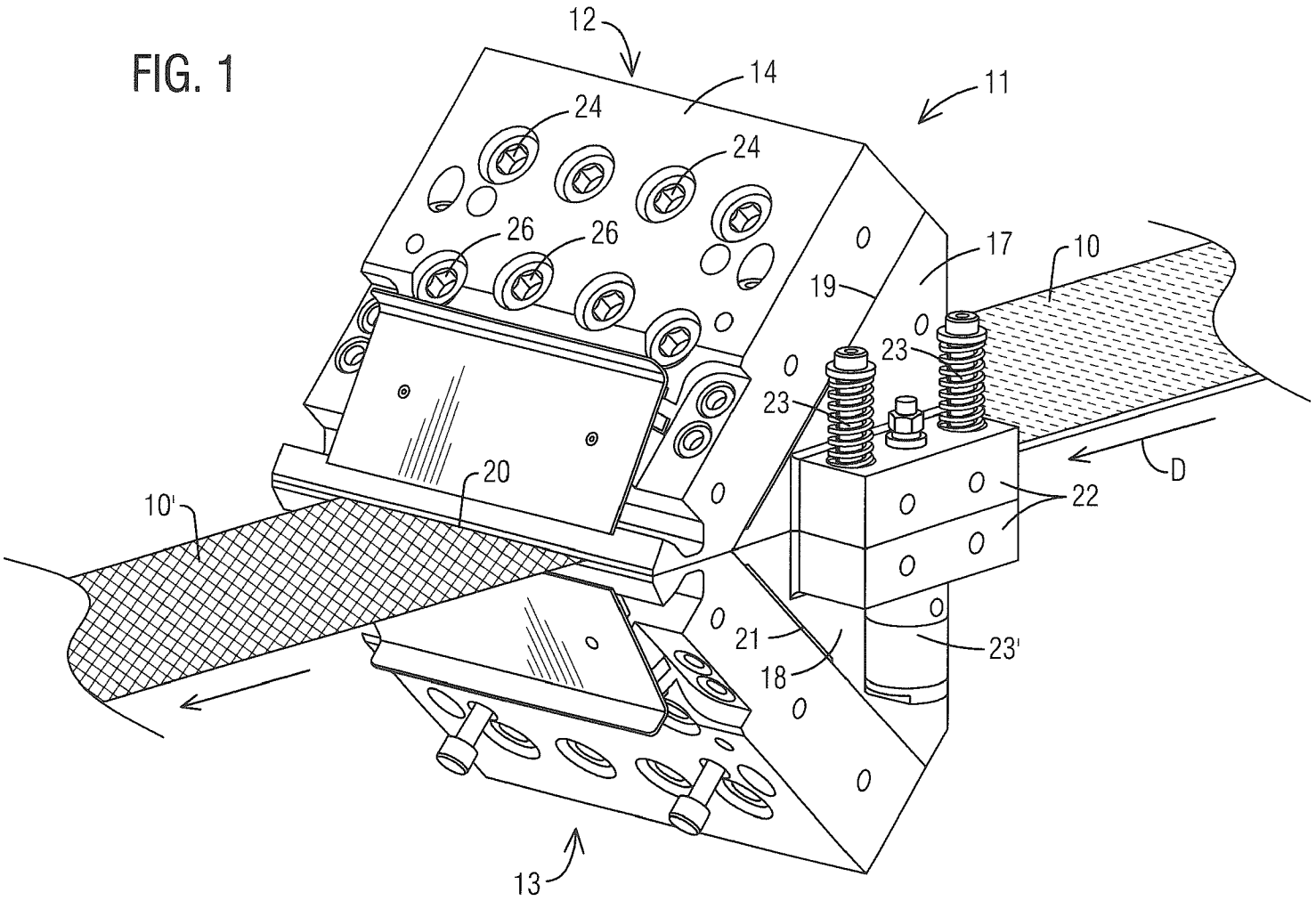
FIG. 1 is an isometric view of an apparatus in the form of a die for coating a moving substrate according to one embodiment of the invention and as seen from a front quarter of the die.

Reference will now be made to the accompanying drawing figures, in which like reference numerals indicate like parts throughout the several views. The invention will be exemplified for clarity of description within the context of roofing shingle manufacturing and more specifically within the context of application of coating materials to a moving glass mat substrate. Such coated substrates subsequently receive protective granules and are cut into shingles. It will be understood, however, that the context in which the invention is described herein are but examples of how the invention may be carried out and that numerous other applications are possible within the scope of the invention.

Figure 2:
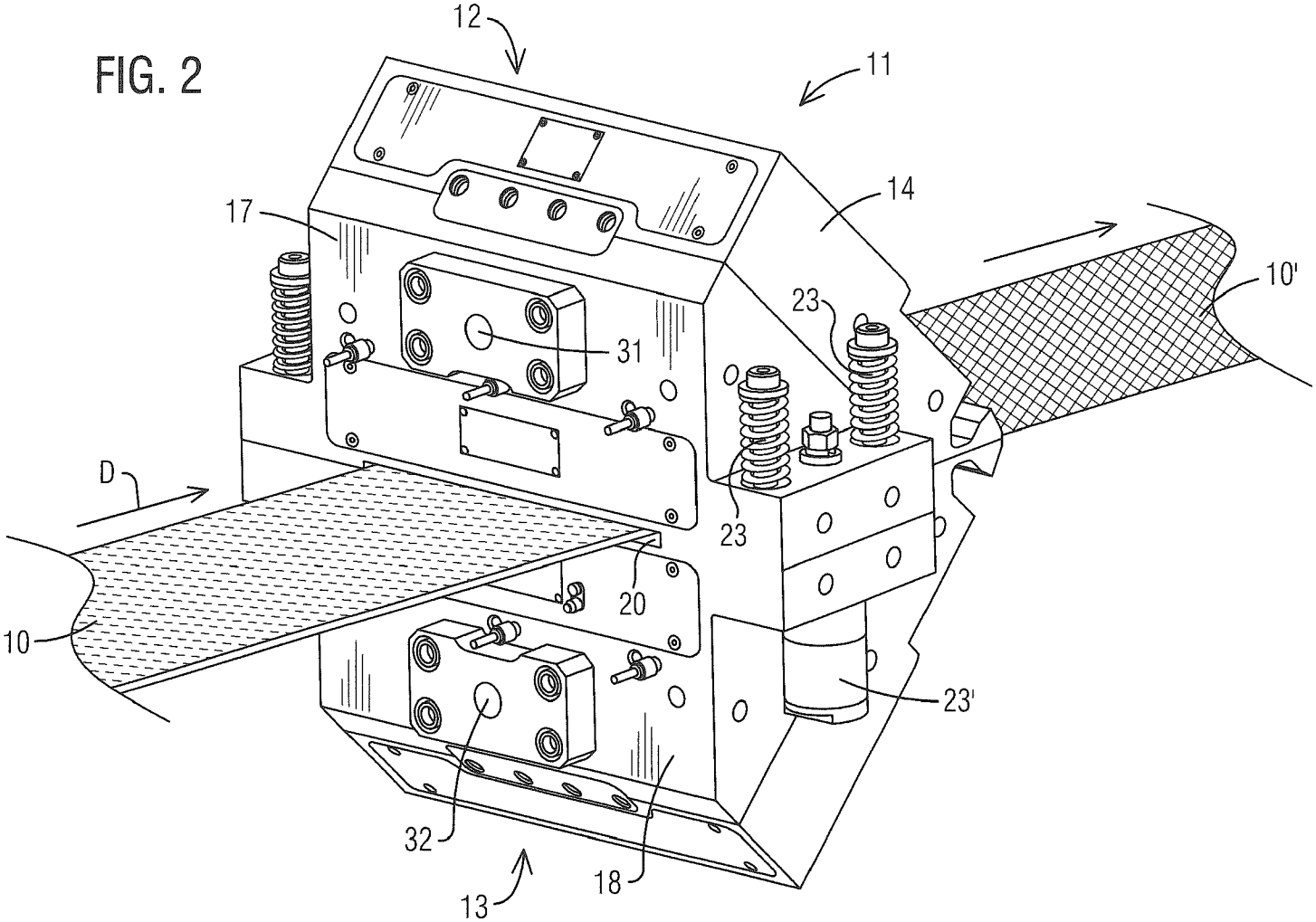
FIG. 2 is an isometric view of a die of FIG. 1 for coating a moving substrate as seen from a rear quarter of the die.

Referring to FIGS. 1 and 2, an apparatus in the form of a generally wedge-shaped pultrusion-type die 11 comprises an upper portion 12 and a lower portion 13. The upper portion 12 is formed from an outer plate 14 that is mounted to a wedge block 17. In the illustrated embodiment, bolts 24 and 26 secure the outer plate 14 and wedge block 17 together so that the outer plate and wedge block will not be deformed or pushed apart by the high pressure of asphalt or other coating material flowing through the die. The outer plate 14 and the wedge block 17 define between them confronting surfaces 19. As described in more detail below, the confronting surfaces 19 are machined and milled to define flow channels through which coating materials can be pumped when the outer plate and wedge block are mounted to one another.

Similarly, the lower portion 13 of the die 11 comprises an outer plate 16 and a wedge block 18 mounted together with bolts 25. The outer plate 16 and wedge block 18 define between them confronting surfaces 21 that are machined and milled to define flow channels through which coating materials can be pumped.

The upper and lower portions 12 and 13 of the die 11 are secured together in an appropriate manner. In the exemplary embodiment of FIGS. 1 and 2, for example, attachment ears 22 project outwardly from the ends of the upper and lower portions 12 and 13 of the die. Preferably, the upper and lower portions 12 and 13 of the die are held together by double-acting pneumatic or hydraulic cylinders 23' operatively coupled to the ears 22. Sets of return springs 23 may be provided to urge the ears and thus the upper and lower portions 12 and 13 of the die toward their closed positions. The upper and lower portions 12 and 13 of the die thus are capable of being moved away from each other to open the elongated channel defined between them. This allows a web of substrate material to be threaded easily between the two portions of the die and/or allows for cleaning and maintenance of the die. The upper and lower portions of the die can then be returned to their operational positions with double acting pneumatic cylinders 23' and optional return springs 23.

When fastened together in their operational positions, the confronting walls of upper and lower portions 12 and 13 of the die 11 are machined to define between them an elongated relatively narrow channel 20. The channel 20 is sized so that a web of substrate material such as a glass mat web 10 can be conveyed through the channel 20 in direction D from the rear of the die to the front edge of the die. Coating materials such as molten asphalt are applied to the substrate web is it traverses the channel of the die, as described in detail below.

As perhaps best seen in FIG. 2, an upper inlet port 31 is formed in the upper wedge block 17 and a lower inlet port 32 is formed in the lower wedge block 18. The upper and lower inlet ports 31 and 32 are configured to be coupled to respective sources of coating material such as, for example, molten asphalt. A powerful pump, not shown but conventional, supplies coating material to the upper and lower inlet ports under relatively high pressure. Further, the pressure, and thus the rate of flow of the coating material, is controllable within an appropriate range by a connected computer or machine controller, not shown but common.

Figure 3:
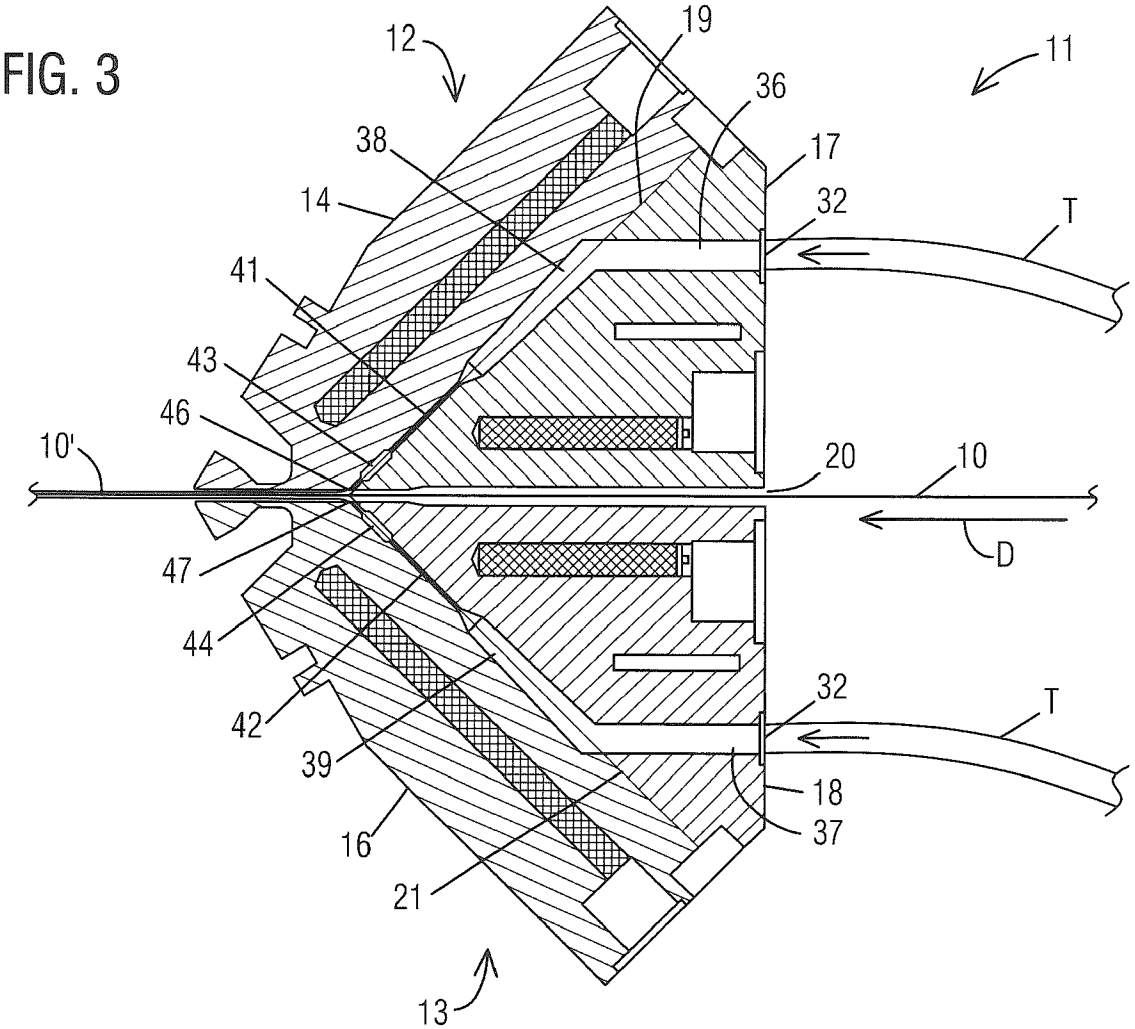
FIG. 3 is a cross sectional view of the die of FIGS. 1 and 2 illustrating one possible configuration of internal coating channels formed therein.

FIG. 3 is a cross-sectional view of the die 11 taken through the coating inlet ports 31 and 32 and shows one preferred configuration of the internal coating material passageways and slot nozzles within the die 11. The following description will be of the upper portion 12 of the die 11, it being understood that the lower portion 13 is a mirror image of the upper portion 12. Referring to the upper portion 12, coating inlet port 31 communicates with a primary plenum chamber 38 through a conduit 36 formed through the wedge block 17. A tube T is attached to the coating inlet port 31 for delivering coating material, usually molten asphalt, to the inlet 31 under controllable pressure.

The primary plenum chamber 31 is formed by cooperating features machined into the confronting surfaces 19 between the outer plate 14 and the wedge block 17. Further, the primary plenum chamber 31 preferably extends along the length of the die 11. In this way, coating material delivered under pressure to the inlet port 31 from a remote pump (not shown) enters the primary plenum chamber and spreads longitudinally therealong from one end portion of the die to the other end portion.

From the primary plenum chamber 38, the coating material is forced through an elongated narrow slot channel 41, which further spreads and homogenizes the coating material. The slot channel 41 delivers the coating material, now in the form of a thin ribbon, to a secondary plenum chamber 43, which also extends longitudinally from one end portion of the die to the other end portion. Within the secondary plenum chamber 43, any remaining discontinuous or non-uniform regions within the ribbon of coating material are eliminated as the coating material fills the secondary plenum chamber and spreads between the ends thereof under the influence of pressure equalization.

From the secondary plenum chamber 43, the coating material, now uniform and homogenous, moves through a slot nozzle 46 that exits along the upper wall of the narrow channel 20 through which a glass mat web 10 is conveyed in downstream direction D. As the coating material is ejected in the form of a uniform thin ribbon from the slot nozzle 46, it is "sprayed" or laid down on the upper surface of the web 10. The coating material is thereby applied to the upper surface of the web as a film.

Since the coating material is ejected as a uniform homogenous ribbon or curtain, the coating applied to the web is extremely uniform in thickness. Furthermore, virtually any desired thickness can be established simply by varying the pressure at which the coating material is supplied to the inlet port 31 of the die and/or varying the size of the channel 20. Alternatively, a uniform thickness of coating material CaO be obtained regardless of the speed at which the web 10 is conveyed through the narrow channel 20 by varying the delivery pressure of the coating material as a function of the speed of the web. Significantly, it is believed that a uniform layer of coating material can be obtained at web speeds or line speeds above 850 feet per minute and even above 1000 feet per minute. Line speeds approaching and exceeding 1000 feet per minute simply are not possible with prior art puddle and roller web coating techniques in the shingle manufacturing industry.

With continuing reference to FIG. 3, the lower portion 13 of the die 11 is a mirror image of the upper portion and includes an inlet port 32, a conduit 37, a primary plenum chamber 39, a slot channel 42, a secondary plenum chamber 44 and a slot nozzle 47. The slot nozzle 47 delivers coating material to the bottom surface of a web 10 in the same manner that the slot nozzle 46 delivers coating material to the top surface of the web. However, unlike prior art coating techniques, the coating material delivered to the bottom surface of the web 10 can be delivered at higher or lower pressures than the coating material delivered to the top surface. In this way, coatings of different thicknesses can be applied to the top and bottom surfaces of the web by appropriate control of the coating pressures.

Further, the coating material delivered to the top surface of the web can be a different material altogether than that delivered to the bottom of the web. For example, the top surface may be saturated and covered with molten asphalt to receive granules downstream while the bottom surface may be coated with an adhesive coating to enhance bonding of shingles when installed. Alternatively, coating material may only be delivered to one surface of the web and not to the other surface. The coating material or materials delivered to the web may be a pre-coat coating material designed to enhance subsequent saturation with a primary coating material. In any of these and other events, high web speeds, i.e. high line speeds, above traditional shingle manufacturing line speeds can easily be accommodated simply by varying the rate at which coating materials are ejected from the slot nozzles 46 and 47 of the die onto a moving shingle substrate.

The just described method and apparatus applies a layer of coating material to the top surface of a moving substrate and a layer of coating material to the bottom surface of the moving substrate. In an alternate embodiment of the invention, the concept is expanded to include multiple spaced apart slot nozzles within a single die that apply coating material to the top surface of a substrate and multiple spaced apart slot nozzles that apply coating material to the bottom surface of the substrate. This expanded embodiment is illustrated in FIG. 4, which is a highly simplified image illustrating a die and method and to which reference will now be made.

Figure 4:
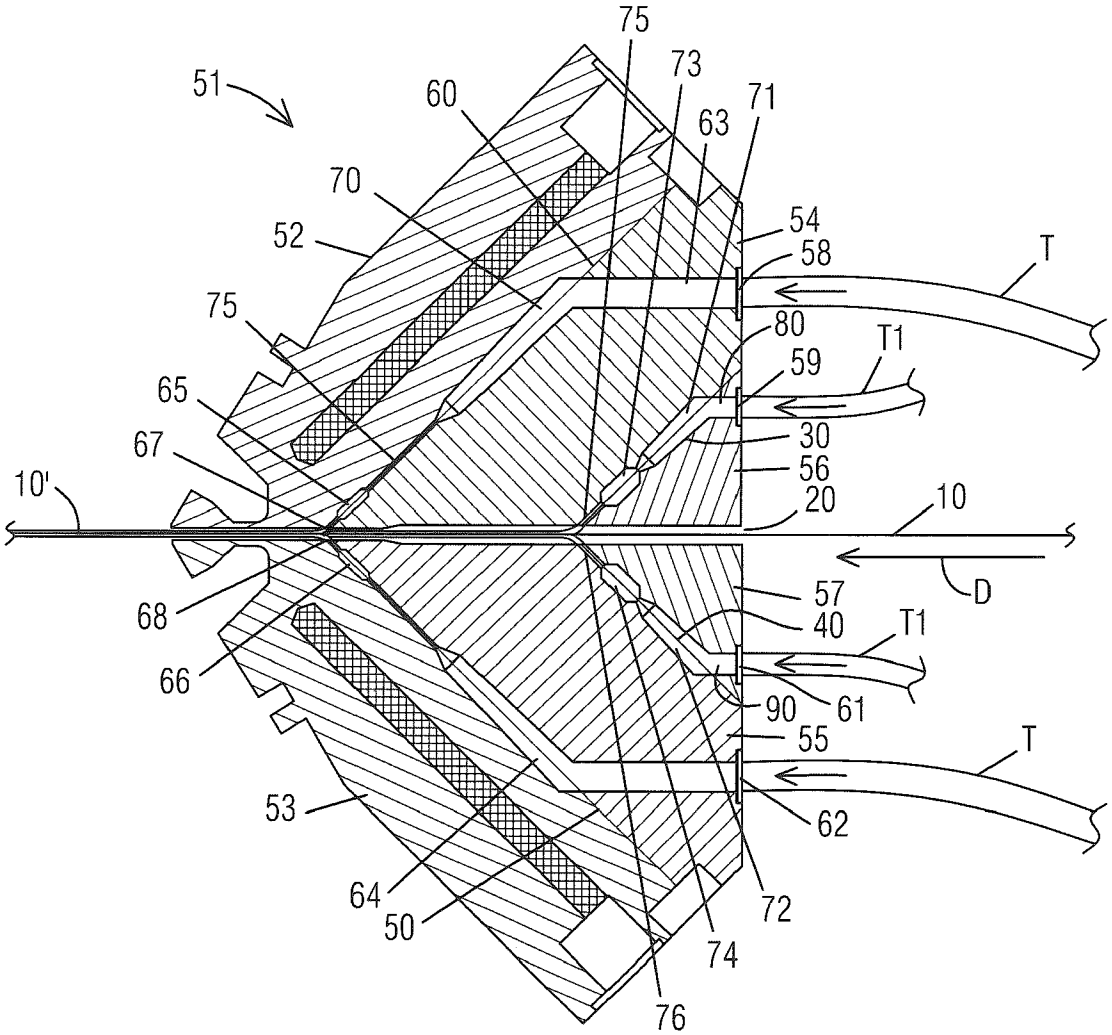
FIG. 4 is a simplified cross sectional view of an apparatus in the form of a die for coating a moving substrate with multiple coating materials according to an alternate embodiment of the invention.

The die 51 in FIG. 4 may be constructed of steel or other metal and may comprise top and bottom plates 52 and 53, top and bottom outer wedge blocks 54 and 55, and top and bottom inner wedge blocks 56 and 57 respectively. The upper portion of the die 51 will be described, it being understood that the lower portion is a mirror image of the upper portion. An inlet channel 63 is formed through the back of the outer wedge block 54 and has a coupler 58 at its upstream end. Coating material such as molten asphalt may be delivered to the coupler 58 and the inlet channel 63 through an appropriate tube T as indicated by the arrow.

The confronting surfaces of the top plate 52 and the top outer wedge block 54 are machined or otherwise formed to define a primary plenum chamber 70 with which the inlet channel 63 communicates. The primary plenum chamber 70 preferably is tapered slightly from its upstream end to its downstream end and its downstream end communicates with a narrower slot channel 75. The slot channel 75, in turn, communicates with a secondary plenum chamber 65 that functions as in the previously described embodiments to spread coating material evenly and uniformly along the length of the die. The plenum chamber 65 communicates with an elongated narrow downstream slot nozzle 67 that exits through the top wall of substrate channel 20. A uniform curtain of coating material is ejected from the slot nozzle 67 onto the top surface of a substrate such as a glass mat moving through the die in the direction D. This applies an even coating of the material, with controllable and variable thickness, to the top surface of the substrate, as described in more detail above.

In a similar fashion, an inlet channel 80 is formed through the back of inner wedge block 56 and originates with a coupler 59. An appropriate tube T1 is attached to the coupler 59 for delivering coating material to the inlet channel as indicated by the arrow. The inlet channel 80 communicates at its downstream end with a primary plenum chamber 71, which is formed by features machined or formed in the confronting surfaces of the top outer wedge block 54 and the top inner wedge block 56. The primary plenum chamber 71 functions to spread the coating material from one end portion of the die to the other end portion.

The primary plenum chamber 71 communicates through a restriction with a secondary plenum chamber 73, which again spreads coating material evenly along the length of the die from one end portion to the other. The plenum chamber 73 in turn communicates with an elongated upstream slot nozzle 75, which exits on the top side of substrate channel 20 upstream of the downstream slot nozzle 67. While a simplified configuration of the slot channels, plenums, and slot nozzles is shown in FIG. 4, it will be understood that these elements may well be more complex, may incorporate more than one plenum, may be tapered, or may have other complexities not depicted in the simplified exemplary drawing of FIG. 4.

The lower portion of the die 51 is a mirror image of the upper portion just described and therefore need not be detailed again here, except to say that the downstream slot nozzle 68 of the lower portion exits through the bottom wall of the channel 20 and the upstream slot nozzle 76 exits through the bottom wall of the channel 20 upstream of the downstream slot nozzle 68.

In operation, a substrate such as a glass mat 10 is conveyed in direction D through the narrow channel 20 extending through the die. As the web traverses the channel 20, a first coating, which may be a saturation coating, may be applied to the glass mat through the slot nozzles 75 and 76. The saturation coating may be applied only to the top of the mat, only to the bottom of the mat, or to both sides of the mat as desired to form a waterproof barrier. Alternatively, different coating materials may be applied to the top and bottom surfaces of the mat to form a single substrate of unique characteristics that are not achievable with prior art pool and roller coating techniques.

Downstream of the slot nozzles 75 and 76, a top coating may be applied to the saturation coating through slot nozzle 67 and a bottom coating may be applied to the saturation coating through slot nozzles 67 and 68. The top coating, for instance, may be a higher quality filled asphalt coating configured to withstand the elements and receive a layer of protective granules. The bottom coating may be of a coating material with different properties than the top coating since this surface will not be directly exposed to the sun. If desired, a bottom coating need not be applied at all depending upon the ultimate intended use and characteristics of shingles being produced. As the multi-coated substrate exits the die, the coating is metered to its desired thickness by passing between the adjustable lips at the forward edge of the slot. The result is a multi-coated shingle substrate 10' with a high quality customized coating of a precise thickness.

As with the previously described embodiment, the pressure at which the coating material is delivered to the die at its various inlet ports can be controlled to apply a coating of consistent thickness and uniformity regardless of the speed at which the mat is conveyed through the channel 20. Thus, consistent coatings can be applied at line speeds far higher than those usable with prior art roll coating techniques.

In addition, a variety of combinations of coatings may be applied as desired with the method and apparatus of this embodiment. For example, a saturation coating of a material such as asphalt that is less expensive or less resilient may be applied through the upstream slot nozzles 75 and 76. A more expensive and weather resistant top coating such as a filled asphalt may then be applied onto the saturation coating through the downstream slot nozzles 67 and 68. This may reduce the cost of shingle production while retaining the desirable properties of the resulting shingles.

Combinations of coatings also are possible with the present invention. For example, one coating material may be applied to the top surface of the mat, which is exposed to the elements in a shingle installation, while a different coating material is applied to the bottom surface, which is not directly exposed to the elements. Materials other than asphalt coatings also may be applied using the system of the present invention. For example, adhesives intended to bond layers together in a multi-layer shingle may be applied. Material may be applied only to certain regions of the substrate such as in strips spaced across its width. The flow of material may be stopped and started during production to apply patches or patterns of material to the substrate.

Perhaps most significantly, however, is that the coating process of the present invention is controllable to apply just the desired thickness of all coatings without waste. For a higher line speed, a correspondingly higher volume of coating material is ejected onto the moving substrate. A desired thickness that is highly consistent can be maintained through flow rate settings and adjustments of the exit tip of the die as necessary. All of these advantages and more can be obtained and maintained at line speeds above 850 feet per minute and even above 1000 feet per minute. The prior speed bottleneck represented by prior art pool and roller coating applicators is thus eliminated.

The invention has been described herein in terms of preferred embodiments and methodologies considered by the inventor to represent the best modes of carrying out the invention. It will be understood by the skilled artisan, however, that the invention is not limited to the exemplary embodiments and a wide gamut of additions, deletions, and modification, both subtle and gross, might well be made to the illustrated exemplary embodiments without departing from the spirit and scope of the invention, which are defined only by the claims.

What is claimed is:

1. An apparatus for applying coatings from one or more sources of coating material under pressure to a moving web of substrate material in the manufacture of shingles, the apparatus comprising:

a die having a body defining a relatively narrow elongated channel bounded by a first wall and a second wall spaced from and opposing the first wall;

the channel being sized to accommodate the moving web of substrate material as the web moves through the channel in a downstream direction with a first surface of the web facing the first wall of the elongated channel and a second opposite surface of the web facing the second wall of the elongated channel;

a first nozzle communicating with the channel through the first wall;

a second nozzle communicating with the channel through the second wall;

a first passageway extending through the body and communicating at one end with the first nozzle and at the other end with a coupler for coupling the first passageway to a selected source of coating material under pressure;

a second passageway extending through the body and communicating at one end with the second nozzle and at the other end with a coupler for coupling the second passageway to a selected source of coating material under pressure;

the first nozzle and the second nozzle being aligned with each other on opposite sides of the channel;

a third nozzle communicating with the channel through the first wall, a fourth passageway communicating with the channel through the second wall, a third passageway extending through the body and communicating at one end with the third nozzle and at the other end with a coupler for coupling the third passageway to a selected source of coating material under pressure, and a fourth passageway extending through the body and communicating at one end with the fourth nozzle and at the other end with a coupler for coupling the fourth passageway to a selected source of coating material under pressure;

the third nozzle being located downstream of the first nozzle and the fourth nozzle being located downstream of the second nozzle; and the third and fourth nozzles being aligned with one another on opposite sides of the channel.

* * * * *